US007363793B2

(12) United States Patent
Benner

(10) Patent No.: US 7,363,793 B2
(45) Date of Patent: Apr. 29, 2008

(54) ROLLING MILL COMPRISING MEANS FOR EXCHANGING THE ROLLS

(75) Inventor: Frank-Günter Benner, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/537,230

(22) PCT Filed: Nov. 15, 2003

(86) PCT No.: PCT/EP03/12790

§ 371 (c)(1),
(2), (4) Date: Jan. 6, 2006

(87) PCT Pub. No.: WO2004/050271

PCT Pub. Date: Jun. 17, 2004

(65) Prior Publication Data

US 2006/0144114 A1 Jul. 6, 2006

(30) Foreign Application Priority Data

Dec. 5, 2002 (DE) ..... 102 56 749

(51) Int. Cl.
*B21B 31/10* (2006.01)

(52) U.S. Cl. ..... 72/238; 72/239

(58) Field of Classification Search ..... 72/238, 72/239, 227, 234

See application file for complete search history.

(56) References Cited

U.S. PATENT DOCUMENTS 3,204,443 A 9/1965 Kalberkamp
3,376,724 A * 4/1968 Wolfendale et al. ..... 72/239
3,667,271 A * 6/1972 Fereday et al. ..... 72/238
3,842,639 A * 10/1974 Petros ..... 72/239
3,975,938 A * 8/1976 Schmidt et al. ..... 72/239
4,435,970 A 3/1984 Sekiya
5,979,206 A * 11/1999 Minnerop ..... 72/239
2002/0078728 A1* 6/2002 Mukaigawa et al. ..... 72/239
2006/0150702 A1* 7/2006 Rackel et al. ..... 72/239

FOREIGN PATENT DOCUMENTS

DE 24 61 005 7/1976
DE 43 21 663 1/1995

* cited by examiner

*Primary Examiner*—Dmitry Suhol
(74) *Attorney, Agent, or Firm*—Friedrich Kueffner

(57) ABSTRACT

The invention relates to a rolling mill (1) comprising several rolling frames (Fi) and support plates (7) that are provided on the operator side (BS) of the frames (Fi) and can be displaced transversally to the roll axes, said plates being equipped to receive sets of working rolls (14) and lying adjacent to the mill floor (9). The mill also comprises pits (8) that are situated on the operator side (BS) upstream of each frame (Fi), the bottom of said pits being configured to deploy sets of support rolls (12). The aim of the invention is to reduce the time required to exchange the rolls. To achieve this: the support plates (7) are arranged in a support plate line (6), directly adjacent to the rolling frames (Fi) and covering pits (8); the support plates (7) are detachably interconnected and in order to exchange the set of support rolls (12), the support plate line (6) can be displaced out of the frame area (5) transversally to the roll axes along the line of the pits, in subgroup (17) of interconnected support plates or in its entirety (6), in order to open at least one and if required all pits (8).

7 Claims, 7 Drawing Sheets

ROLLING MILL COMPRISING MEANS FOR EXCHANGING THE ROLLS

The invention concerns a rolling mill with several rolling stands and with support plates, which are provided on the operator side of the stands, can be moved transversely to the roll axes, are equipped for receiving sets of work rolls, and border on the mill floor. Pits are situated on the operator side upstream of each stand, and the bottom of each pit is equipped for moving out sets of backup rolls.

Rolling mills are known which have pits that are overlapped by transversely displaceable support plates, i.e., support plates that can be moved in the rolling direction or against the rolling direction. To change the work rolls, they are moved out of the rolling stands by roll-changing cylinders and set down on pairs of rails of the support plates. A new set of work rolls that has been set down on a parallel pair of rails of each support plate is pushed in front of each rolling stand by transverse displacement of the support plates. The roll-changing cylinders can then move the new sets of work rolls into the stands. Tractors can take the used sets of work rolls, possibly after another transverse displacement of the support plates, and move them into the roll workshop. To accomplish a backup roll change, in which the sets of backup rolls are moved into the pits, the support plates are lifted by cranes and stacked. This takes a considerable amount of time.

To solve this problem DE 43 21 663 A1 proposes that the pits, which are arranged between the rolling stands and the transversely displaceable line of support plates, be provided with swiveling covers. These covers are situated in a horizontal position for a work roll change, whereas for a backup roll change, they are moved to unblock the pit to allow the sets of backup rolls to be moved in. In this previously known rolling mill with pits that are located between the rolling stand line and the support plate line and can be closed by covers, the work rolls must be moved over the covers and onto the support plates. The transverse displacement and the exchange of the work rolls do not occur until the work rolls are on the support plates. Therefore, the displacement distance is relatively long and a correspondingly large amount of time is required.

Proceeding on the basis of this prior art, the objective of the invention is to create a rolling mill in which both the work roll change and the backup roll change can be accomplished within a short time sequence, the roll change process can be more efficiently designed, and the production time of the plant can thus be increased.

This objective is achieved by an installation with the features of claim 1. Advantageous modifications are described in the dependent claims.

The core of the invention lies in the fact that the support plates, which cover the pits directly next to the rolling stands and undertake the transverse displacement for the work roll change, can be partially or completely moved out of the pit area and thus out of the rolling stand area to carry out a backup roll change, either individually for a specific rolling stand or completely for the whole rolling train. For this purpose, the individual support plates are detachably connected with one another, so that optionally the entire support plate line or the support platform or only individual sets of support plates can be moved. This also makes it possible especially for individual rolling stands of a multiple-stand rolling mill to be equipped more quickly with new backup rolls. In addition, in the position for making a backup roll change, the used or new work rolls can remain on the support plates. Consequently, this eliminates the additional changing time that would otherwise be required for each backup roll change.

The displacement area necessary for moving the support plate line is set in the mill floor. It can also be covered with a cover that forms the mill floor, so that the displacement area is available for other purposes, for example, as a set-down surface.

A very advantageous bolt-key connection is proposed for coupling the individual plates. It can be opened and locked especially with a special tool, which is described below.

The invention is explained in greater detail below with reference to the drawings.

Figure 1:
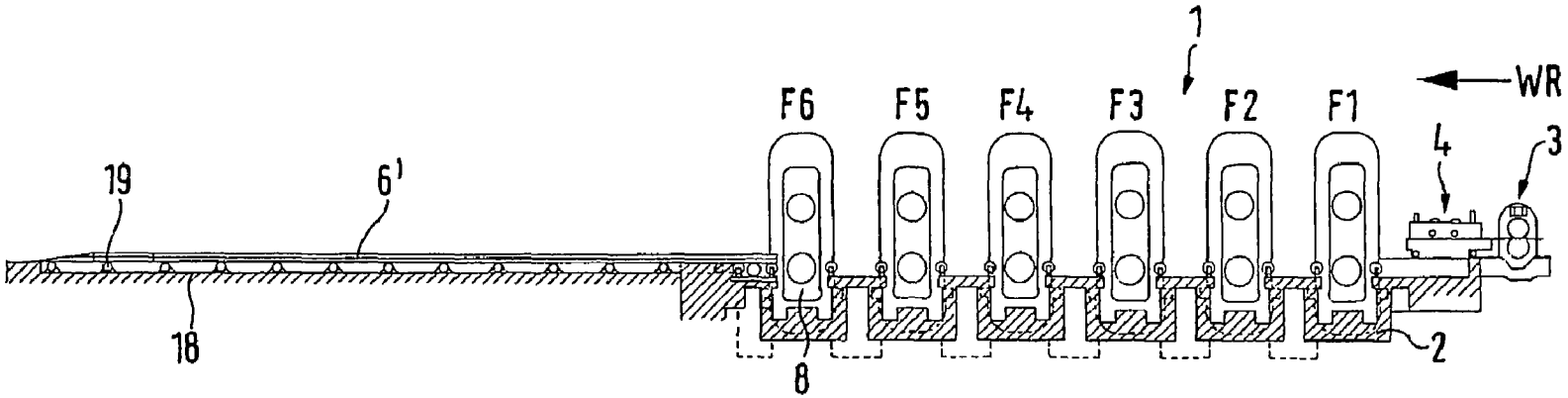
FIG. 1 shows a side view of a rolling mill with rolling stands and a support plate line arranged directly parallel to it with a displacement area for the support plates in the completely extended state of the support plate line or support platform.
Figure 2:
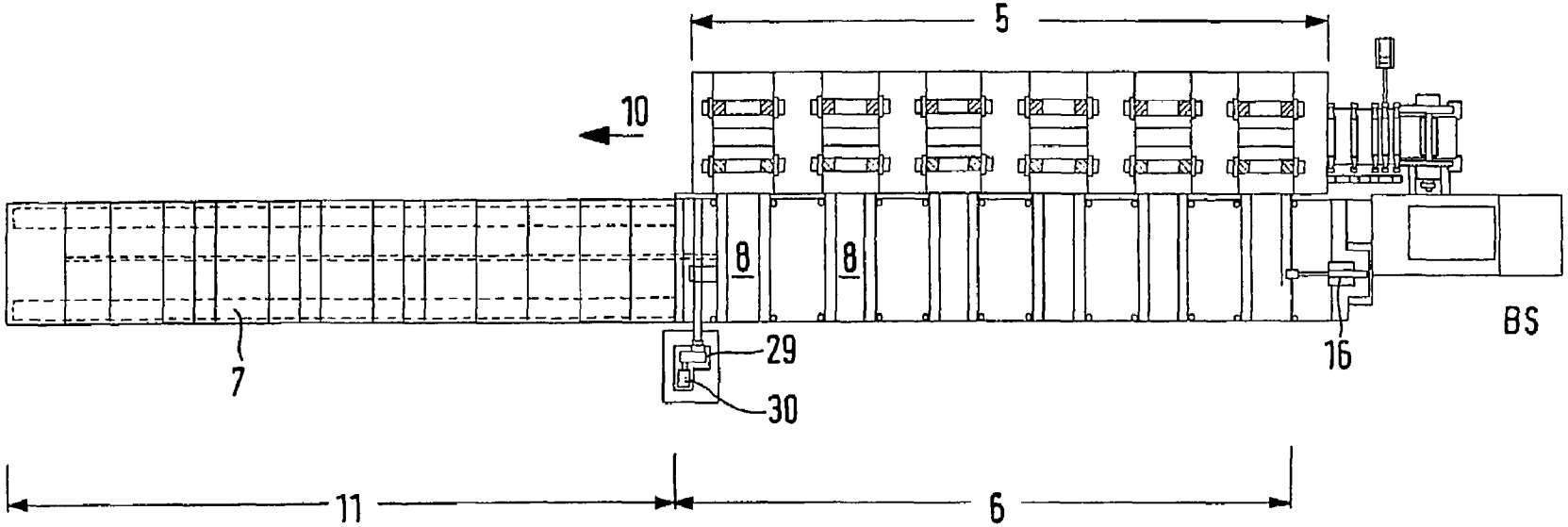
FIG. 2 shows a top view of the rolling mill in FIG. 1.

FIG. 1 shows a side view of a rolling mill 1 with six rolling stands (F1-F6), which are permanently anchored on a foundation 2. The rolling direction WR is indicated by an arrow. A shearing station 3 and a descaling station 4 can be installed upstream of the rolling mill 1. As FIG. 2 illustrates, a support plate line 6 of individual support plates 7 is arranged on the operator side (BS) of the rolling mill and immediately adjacent and parallel to the rolling stand area 5 formed by the succession of individual rolling stands. The support platform, i.e., the totality of all support plates 7, consists of one support plate 7 per rolling stand F1-F6. For a work roll change, these support plates 7 are arranged above pits 8, which are located below the mill floor 9 (see FIG. 3). The rolling stand area 5 is followed, as seen in the rolling direction WR, by the runout area 10 for the rolling stock. Parallel to this runout area 10, a displacement area 11 for the support plates 7 extends in continuation of the pit line. This displacement area 11, which is designed as a roller conveyor, is designed so long by its extension that all of the support plates 7 of the support plate line 6 can be moved in their entirety from the rolling stand area 5 parallel to the runout area 10, and thus all pits 8 can be uncovered for changing the backup rolls 12. This extended state of the support platform is shown in FIGS. 1 and 2. 6' denotes the total displaced support platform.

Figure 3:
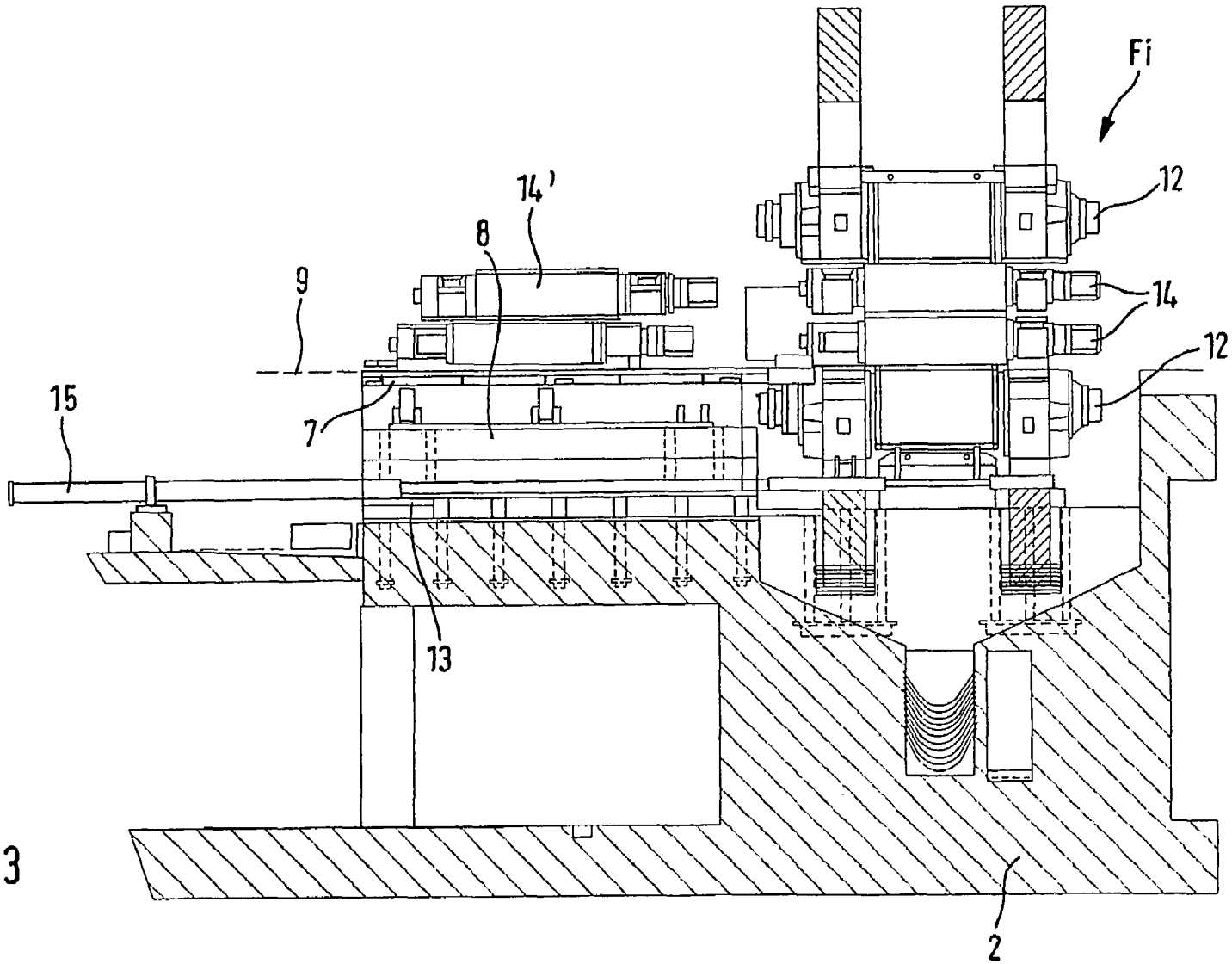
FIG. 3 shows a sectional view through the rolling mill.

The work roll change or backup roll change with transversely displaceable support plates 7 and pits 8 will be explained with reference to FIG. 3.

A pit 8, at the bottom of which runout rails 13 for the sets of backup rolls 12 are installed, is located next to a rolling stand Fi, which is installed on a foundation 2. The runout movement is effected by a runout cylinder unit 15. For a work roll change, the respective pits 8 are covered with the support plates 7 in extension to the mill floor 9, and the support plates 7 are provided with suitable pairs of rails for moving the sets of work rolls 14 in and out. Tractors (not shown) pull the used work rolls 14' onto the support plates 7 and possibly back to the roll workshop. The transverse displacement of the support plates 7 for the work roll change is accomplished by means of a hydraulic cylinder 16 (see FIG. 2). When it is time to carry out a backup roll change, the support plates 7 are moved out over the pits 8 transversely to the roll axes and into the traversing area 11. The pits 8 are then available for running in the sets of backup rolls 12 or for changing the backup rolls.

Figure 4:
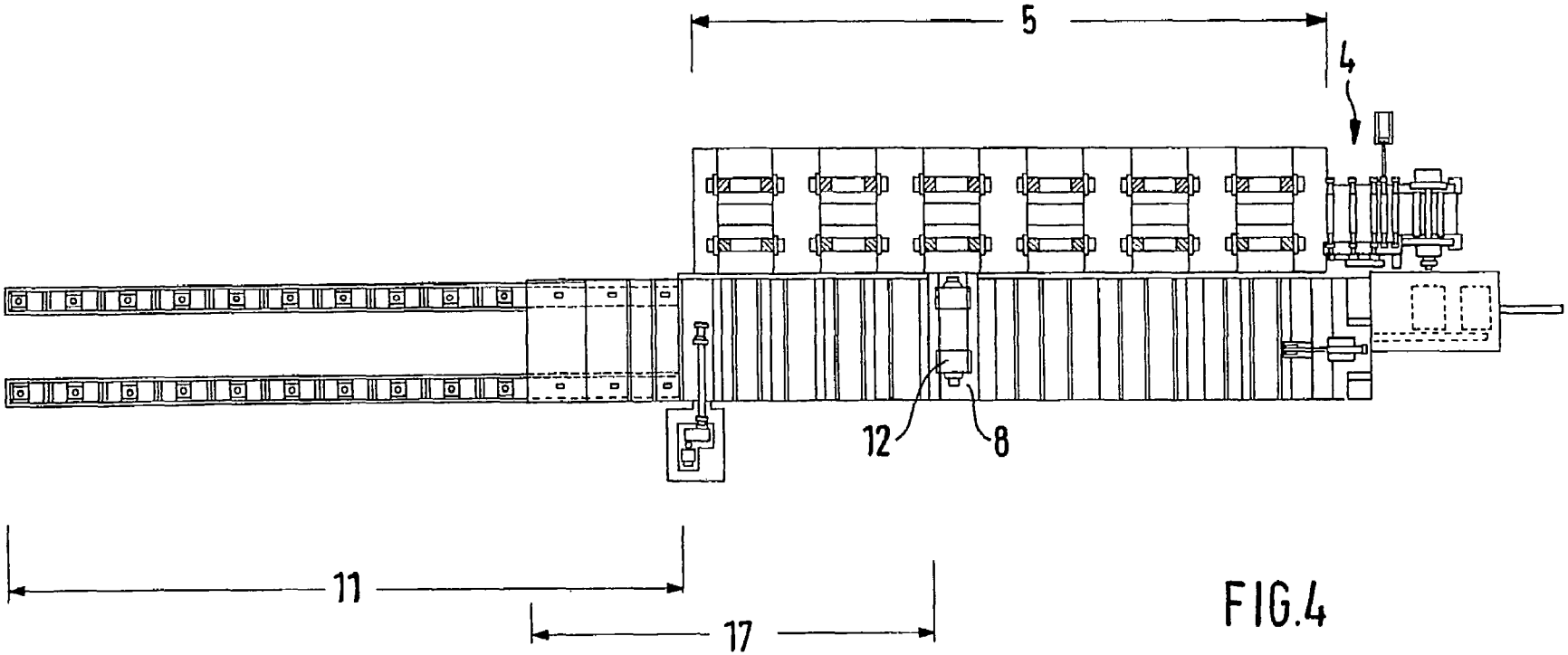
FIG. 4 shows a top view of the rolling mill in FIG. 1 with the support plate line only partly extended.

In accordance with the invention, as FIG. 4 shows, all the support plates 7 can be displaced in their entirety, or only subgroups 17 or subsets of support plates can be displaced to open the pit 8 of a desired individual rolling stand. To open the pit 8 of the fourth rolling stand F4 (shown here as an example), the support plates arranged after it in the rolling direction as well as the support plate assigned to the fourth rolling stand are moved as a set 17 by the length of one support plate in the rolling direction WR. The set of backup rolls 12 of the fourth rolling stand F4 can then be moved into the now open pit 8 and changed.

Figure 5:
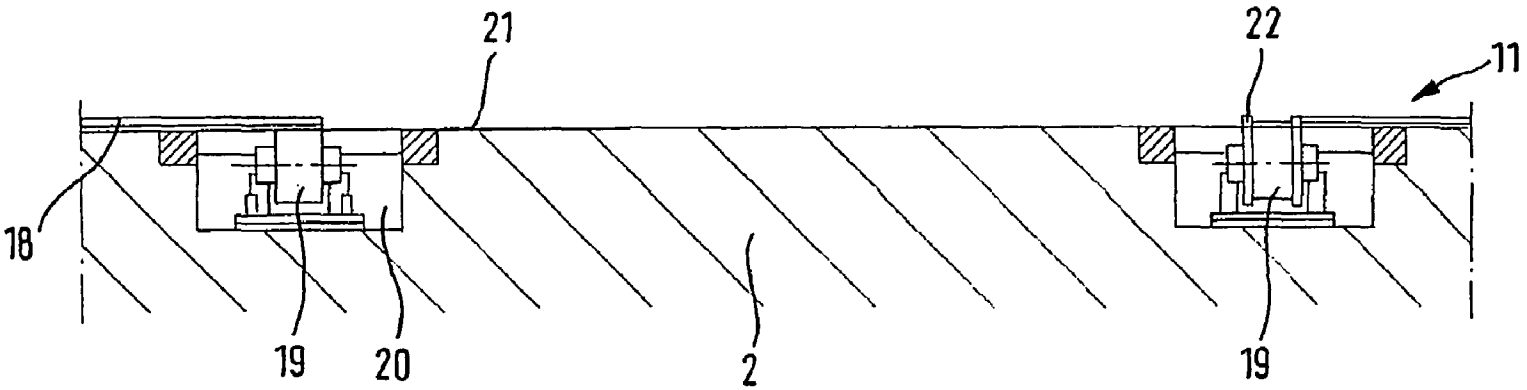
FIG. 5 shows the sectional view F-F in FIG. 1 to illustrate the arrangement of the track rollers in accordance with a first embodiment of the displacement area.
Figure 6:
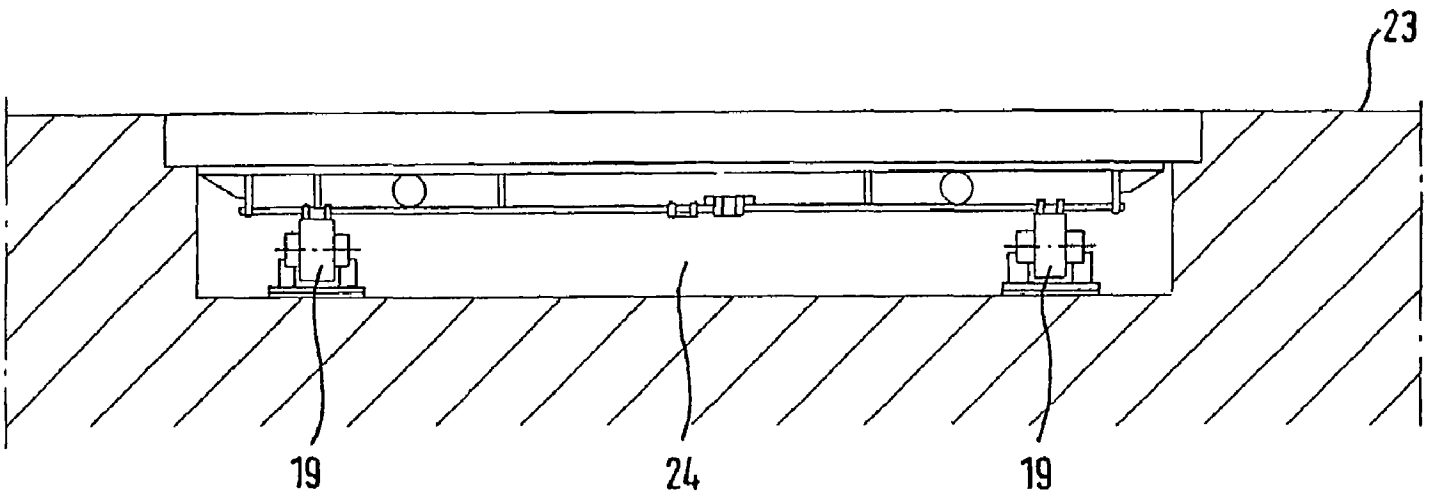
FIG. 6 shows a sectional view F-F to illustrate the arrangement of the track rollers in accordance with a second embodiment of the displacement area.
Figure 7:
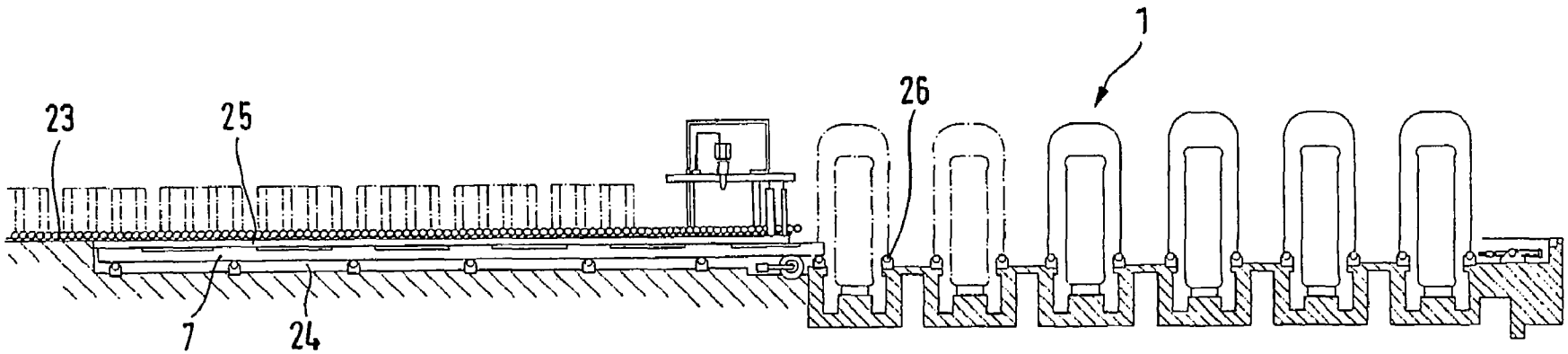
FIG. 7 shows a side view of a second embodiment of the rolling mill with a displacement area for the support plate line below the mill floor in the extended state.

In the embodiment that has been discussed so far, the displacement area 11 for the displaced support plates 7 is arranged above the mill floor 18 after the rolling train. The mill floor 18 in the runout area is arranged at a sunken level about 350 mm below the mill floor 9 in the rolling stand area. In this regard, FIG. 5 illustrates the arrangement of the carrying rollers 19 of the roller conveyor for conveying the support plates 7 in the displacement area 11. The carrying rollers 19 are set in sunken tracks 20 in the foundation 2. Despite the carrying roller tracks 20, a relatively flat surface 21 is formed, over which vehicles can be driven, such as a truck or a mobile crane. The support platform as a whole is moved over these carrying roller tracks 20 and over the mill floor 18. The carrying rollers are preferably provided with a bilateral guide flange 22. In this variant with a sunken mill floor 18, although the displacement area 11 can be driven over by vehicles, it must always be kept free to allow the pits to be opened. To circumvent this, in another embodiment, the mill floor 23 in the displacement area 11 is raised relative to the mill floor 9 in the rolling stand area; in this case, the support plates 7 run over the carrying rollers 19 below the mill floor 23 along the carrying roller tracks 24, which are then open between the rollers 19 (see FIG. 6). FIG. 7 shows that the carrying roller tracks 24 are provided with a cover 25, so that the support plates 7 or the support platform can be moved under the cover 25. This makes it possible for the plane of the cover and thus the mill floor 23 above the displacement plane to be used for other purposes.

Figure 8:
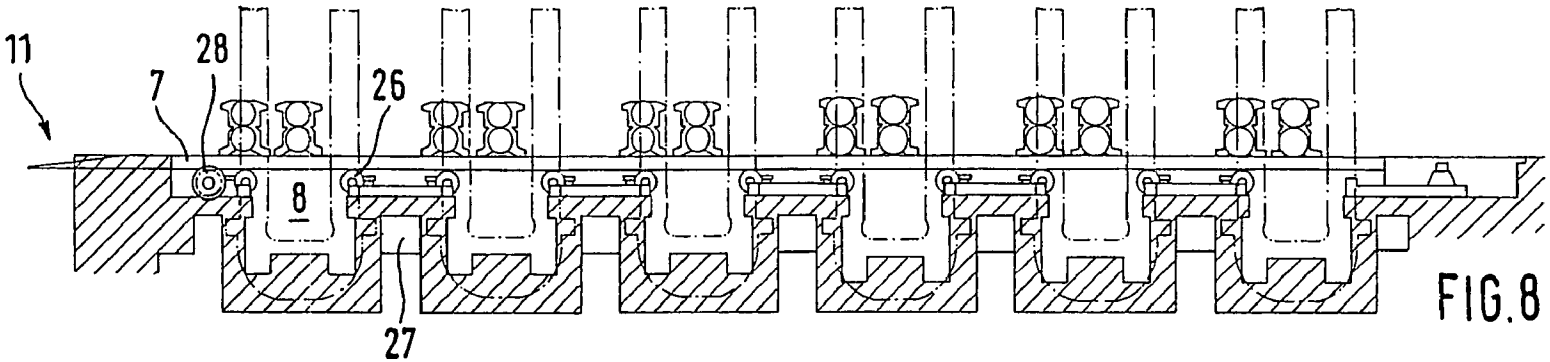
FIG. 8 shows a side view of the rolling mill with detail of the foundation of the support plates.
Figure 9:
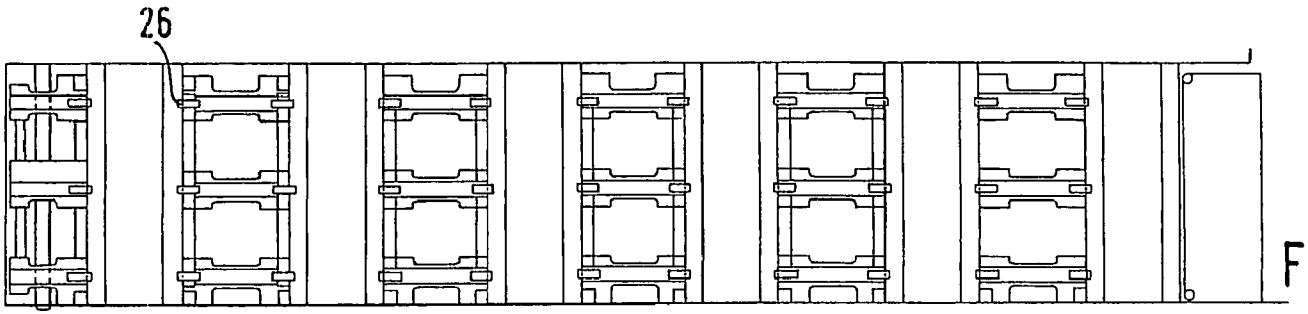
FIG. 9 shows a top view of the rolling mill in FIG. 8.
Figure 11:
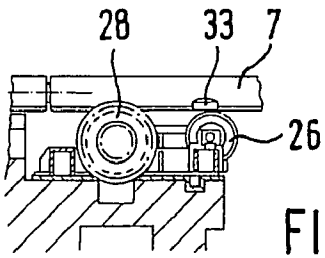
FIG. 11 shows the sectional view G-G of FIG. 10.
Figure 10:
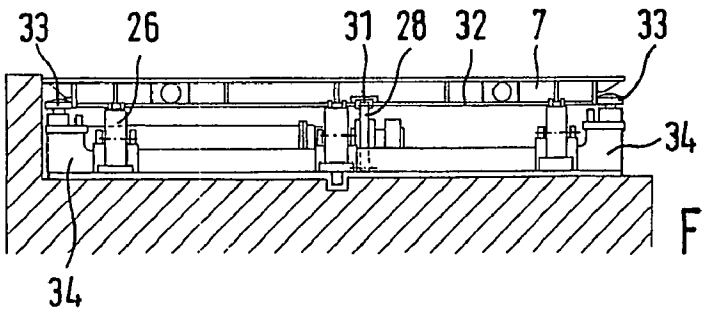
FIG. 10 shows the sectional view F-F of FIG. 8.

FIGS. 8 and 9 illustrate the foundation in the pit area 8 for realizing roller conveyors. In the illustrated example, three track rollers 26 are mounted along the walls of each pit, which extend parallel to the roll axis, by means of bearing blocks 27 on the foundation 2. The bearing blocks 27 are located between the individual rolling stands Fi. In the transition from the rolling stand area 5 to the displacement area 11, there is a lantern pinion 28, which is an advantageous example of a possible drive mechanism. It is driven by a set of gears 29 of an electric motor 30 (see FIGS. 2, 10, and 11). The drive mechanism consists, for example, of a direct-current motor, a spur gear system, an electromagnetic toothed clutch, and a shaft, which drive the lantern pinion 28. The lantern pinion 28 engages mangle gearing 31 on the underside 32 of the individual support plates 7. To prevent the support plates 7 from tilting during the displacement movement, lateral guide rollers 33, which roll along the lateral surfaces of the plates 7, are provided. They are also mounted on bearing blocks 34.

Figure 12:
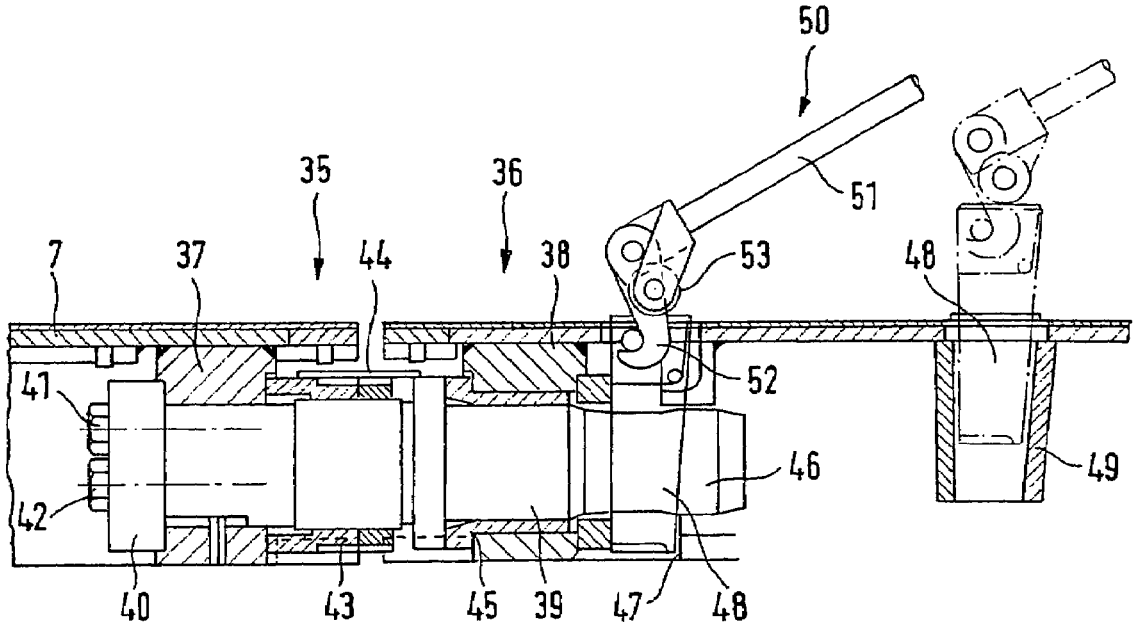
FIG. 12 shows a cross section of a connection of two abutting support plates with a bolt-key connection with a key extractor.

To allow a displacement movement of the support plates 7 as a total set or support platform or as a subset, the support plates 7 must be detachably connected with one another. As FIG. 12 illustrates, the abutting plate ends 35, 36 are coupled by means of an especially advantageous bolt-key connection. For this purpose, flanges 37, 38 are welded onto the undersides of the plates, and each flange has a bore for receiving a common bolt 39. The bolt 39, which extends along the end regions 35, 36 of the plates, is passed through the flange 37 of one plate and fastened by screws 41, 42 with the aid of a holding plate 40 and projects beyond the plate end 35. Guide elements 43, which radially support the bolt 39 and are spanned with a locking plate 44, are mounted on the flange 37 itself. To connect two plates, the bolt 39 engages the flange 38 of the other plate. The second plate is positioned by means of a stop edge 45. Locking is then accomplished by inserting a key 48 into the projecting end 46 of the bolt 39, which is provided with a suitable receiving hole 47 for the key 48. To open the connection, the key 48 is removed and lowered into a key storage recess 49, which is set in the plate surface adjacent to the bolt 39. This bolt-key connection together with the key storage recess 49 offers a reliable and more or less trouble-free connection, which, in particular, is able to withstand the rough conditions in the rolling mill very well.

Figure 13:
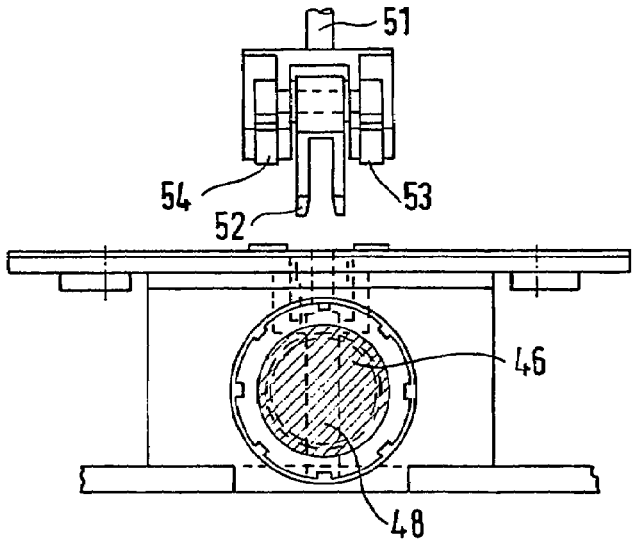
FIG. 13 shows a sectional view of FIG. 12 with the key extractor not yet in position.

As FIG. 13 also illustrates, a key extractor 50 is provided for opening the connection or removing the locking keys 48. This key extractor 50 consists of a hook 52, which is rotatably supported on a rod 51 or lever, and two withdrawing rollers 53, 54 mounted below the pivot bearing. The withdrawing rollers 53, 54, which make contact with the plate 7, guarantee a large lever arm and a well-defined extraction point for the key 48.

The proposed rolling mill allows both a fast work roll change by a short transverse displacement of the support plates and a fast backup roll change by transverse displacement of the support plates out of the respective pit area or out of the entire rolling stand area into a displacement area provided for this purpose in the form of a roller conveyor. To this end, all of the support plates are connected with one another and thus provide a total support platform, which can be separated as required. The roll change is made with the aid of support plates that can be transversely displaced in the rolling direction.

LIST OF REFERENCE SYMBOLS

1 rolling mill
2 foundation
3 shearing station
4 descaling station
5 rolling stand area
6 support plate line (6' displaced support platform)
7 support plates
8 pits
9 mill floor before the rolling mill and in the rolling stand area
10 runout area
11 displacement area
12 backup rolls
13 runout rails

14 work rolls (14' used work rolls)
15 runout cylinder unit
16 hydraulic cylinder
17 subgroups of support plates of the total platform 6'
18 sunken mill floor
19 carrying rollers
20 carrying roller track
21 flat surface
22 guide flange of the carrying rollers
23 raised mill floor
24 carrying roller tracks
25 cover
26 track rollers
27 bearing blocks
28 lantern pinion
29 set of gears
30 electric motor
31 mangle gearing
32 underside of a support plate 7
33 lateral guide rollers
34 bearing blocks of the lateral guide rollers
35 end of a plate 7
36 end of a plate 7 abutting the end 35 of a plate 7
37 flange on a plate
38 flange on a plate
39 bolt
40 holding plate
41 screw
42 screw
43 guide element
44 locking plate
45 stop edge
46 projecting end of the bolt
47 receiving hole in the bolt for the key
48 key
49 key storage recess
50 key extractor
51 rod
52 hook
53 withdrawing roller
54 withdrawing roller
Fi (F1-F6) rolling stands
WR rolling direction
BS operator side

The invention claimed is:

1. Rolling mill (1) with several rolling stands (Fi), with support plates (7), which are provided on the operator side (BS) of the stands (Fi), can be moved transversely to the roll axes, are equipped for receiving sets of work rolls (14), and border on the mill floor (9), and with pits (8), which are situated on the operator side (BS) of each stand (Fi), such that the bottom of each pit (8) is equipped for moving out sets of backup rolls (12), wherein the support plates (7) are arranged in a support plate line, which is immediately adjacent to the rolling stands (Fi) and covers the pits (8); that the support plates (7) are detachably connected with one another; and that, to carry out a change of the backup rolls (12), the support plate line (6), either in subgroups (17) of interconnected support plates or in its entirety (6'), can be displaced out of a rolling stand area (5) transversely to the roll axes along the pit line to open at least one pit (8) and, if necessary, all of the pits (8).

2. Rolling mill in accordance with claim 1, wherein a displacement area (11) of the support plate line, which follows the rolling stand area (5), is designed as a roller conveyor with carrying rollers (19) for the support plates.

3. Rolling mill in accordance with claim 2, wherein a mill floor (23) in a displacement area (11) of the support plate line, which follows the rolling stand area (5), is raised relative to the mill floor (9) in the rolling stand area (5), and the support plate line can be displaced below the mill floor (23).

4. Rolling mill in accordance with claim 3, wherein the displacement area (11) is provided with a cover (25), which is arranged some distance from the carrying rollers (19) and forms the mill floor (23) in the displacement area.

5. Rolling mill in accordance with claim 1, wherein a mill floor (18) in a displacement area (11) of the support plate line, which follows the rolling stand area (5), is sunken relative to the mill floor (9) in the rolling stand area (5), and the support plate line can be displaced above the mill floor (18).

6. Rolling mill in accordance with claim 1, wherein the detachable connection between the support plates (7) is a bolt-key connection (39, 48).

7. Rolling mill in accordance with claim 1, wherein the support plates (7) are conveyed by track rollers (26), which are mounted in the rolling stand area (5) along the pit walls, which extend parallel to the roll axes, by means of bearing blocks (27).

* * * * *